United States Patent [19]

Hubbard

[11] Patent Number: 4,860,931

[45] Date of Patent: Aug. 29, 1989

[54] KEG TAP

[75] Inventor: Julian D. Hubbard, Monaco, Monaco

[73] Assignee: Romneya Trading Co., England

[21] Appl. No.: 168,767

[22] Filed: Mar. 16, 1988

[30] Foreign Application Priority Data

Mar. 21, 1987 [DE] Fed. Rep. of Germany ..... 3709334

[51] Int. Cl.[4] ..... B65D 83/06

[52] U.S. Cl. ..... 222/400.8; 222/517

[58] Field of Search ..... 222/400.5, 400.7, 400.8, 222/401, 402, 402.1, 399, 517

[56] References Cited

U.S. PATENT DOCUMENTS

| | | | |
|---|---|---|---|
| 1,749,216 | 3/1930 | Goldman | 222/402 X |
| 1,795,510 | 3/1931 | Schanze et al. | 222/401 X |
| 1,993,255 | 3/1935 | Baggett et al. | 222/400.8 |
| 2,024,422 | 12/1935 | Brogniez et al. | 222/400.8 |
| 3,599,843 | 8/1971 | Johnston | 222/399 |
| 4,516,698 | 5/1985 | Cerrato | 222/400.7 X |
| 4,717,048 | 1/1988 | Stenger | 222/400.8 |

*Primary Examiner*—Michael S. Huppert
*Attorney, Agent, or Firm*—Fidelman & Wolffe

[57] ABSTRACT

A keg tap described is for domestic use, and in it an axially shiftable valve-opening rod (3) with a valve-opening element (4) is guided through an essentially cylindrical housing (1) enclosing a pressure space (2) and is inserted through a piston (8) which is arranged in the lower region of the housing (1) and which limits the pressure space (2) located here. The valve-opening rod (3) is at the same time a riser pipe and has a continuous liquid passage (7) which leads outwards from the valve-opening element (4) at one end and which, at the opposite end, merges into a liquid duct (17) cut out in a stirrup (15) arranged essentially at right angles to the liquid passage (7) and equipped with a shut-off valve (19) and with a consequently closable outflow (18). The piston (8) closing off the pressure space (2) is connected via piston rods (14) to a handle (5), by means of which the piston (8) is actuated independently of the valve-opening rod (3).

5 Claims, 1 Drawing Sheet

Fig. 2
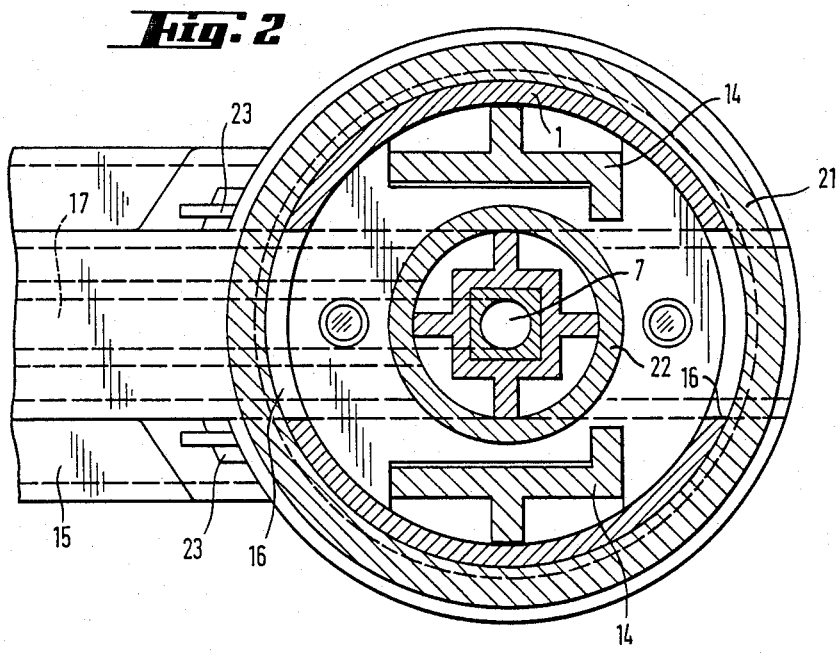
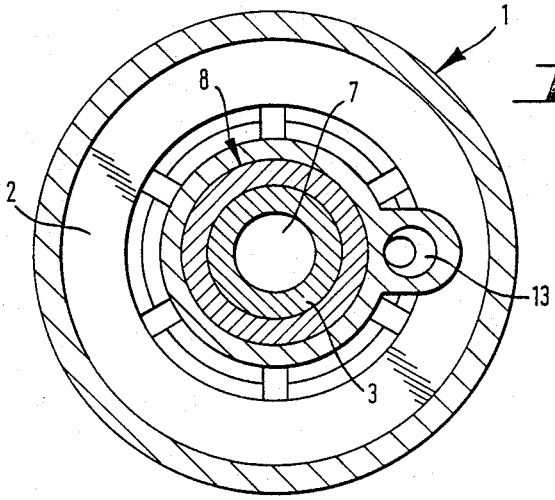
Fig. 3

KEG TAP

The invention relates to a keg tap for dispensing a liquid, especially a pressurized beverage, from a vessel equipped with a keg seal, comprising a housing which is connected to a pressure-generating element and encloses a pressure space and through which is inserted an axially movable valve-opening rod which interacts with the keg seal and which is designed as a valve-opening element at one end projecting beyond the housing wall and is connected to an actuating part at its opposite end.

Keg taps are used in gastronomy for tapping beer from casks, heads for a basket-fitting and those for a flat fitting being known. Both versions comprise a housing which encloses a pressure chamber and through which a lever-actuated valve-opening rod is inserted in order to open the valve of the keg seal. The tap head has a compressed-gas connection and a connection for a hose leading to the tapping cock. Keg taps of this type are not suitable for domestic use.

The object of the invention is to provide a keg tap of the type mentioned in the introduction, which is suitable for extracting beverages from casks and barrels customary in domestic use and which is handy, simple to manipulate and easy to clean.

This object is achieved by means of a keg tap of the type mentioned in the introduction, wherein the housing is essentially cylindrical, and the valve-opening rod extending over the entire height of the housing has a continuous liquid passage opening outwards in the valve-opening element and merging, at its opposite end, into a liquid duct which, here, is arranged essentially at right angles to the liquid passage and which is cut out in a stirrup inserted through a recess in the wall of the housing and also having an outflow for the liquid, closable by means of a shut-off valve, herein the pressure space is provided in the lower region of the housing interior and is limited by a piston connected by means of piston rods to a handle at the opposite end of the housing and having a central axial bore, through which the valve-opening rod is inserted and is axially shiftable sealingly therein independently of the piston movement, and the piston is equipped with a piston gasket which, when the piston is actuated, opens or closes an outlet for a pressure medium into the pressure space in the housing, and wherein an outflow duct for the pressure medium, equipped with a non-return valve, leads out of the pressure space.

Expedient developments are defined in the subclaims.

Such a keg tap is advantageously suitable for vessels equipped with a keg seal, for example a cask or a barrel. By means of the keg tap, it is now also possible to tap a beverage from vessels having keg seals in the domestic environment. It is extremely handy and easy to manipulate and is not susceptible to faults. The advantage of the simple straight path for the liquid without multiple deflections is obvious. The vertical fluid passage in the valve-opening rod inside the housing is deflected only into the likewise straight horizontal liquid conduit and is extracted from this directly behind the shut-off valve in a way known per se. In addition to a simplification in production terms, a hygienic effect is achieved as a result of the simple and reliable cleaning of such a keg tap. Finally, a vessel to be opened by means of the keg tap according to the invention is not dependent on hose connections and not tied to a particular place and can therefore be set up for use at any location desired.

The invention is explained in detail by reference to an exemplary embodiment illustrated in the drawings. In these:

FIG. 2 shows a cross-sectional view, as seen in the direction of the arrows A—A in FIG. 1;.and FIG. 3 shows a cross-sectional view, as seen in the direction of the arrows B—B in FIG. 1.

Figure 1:
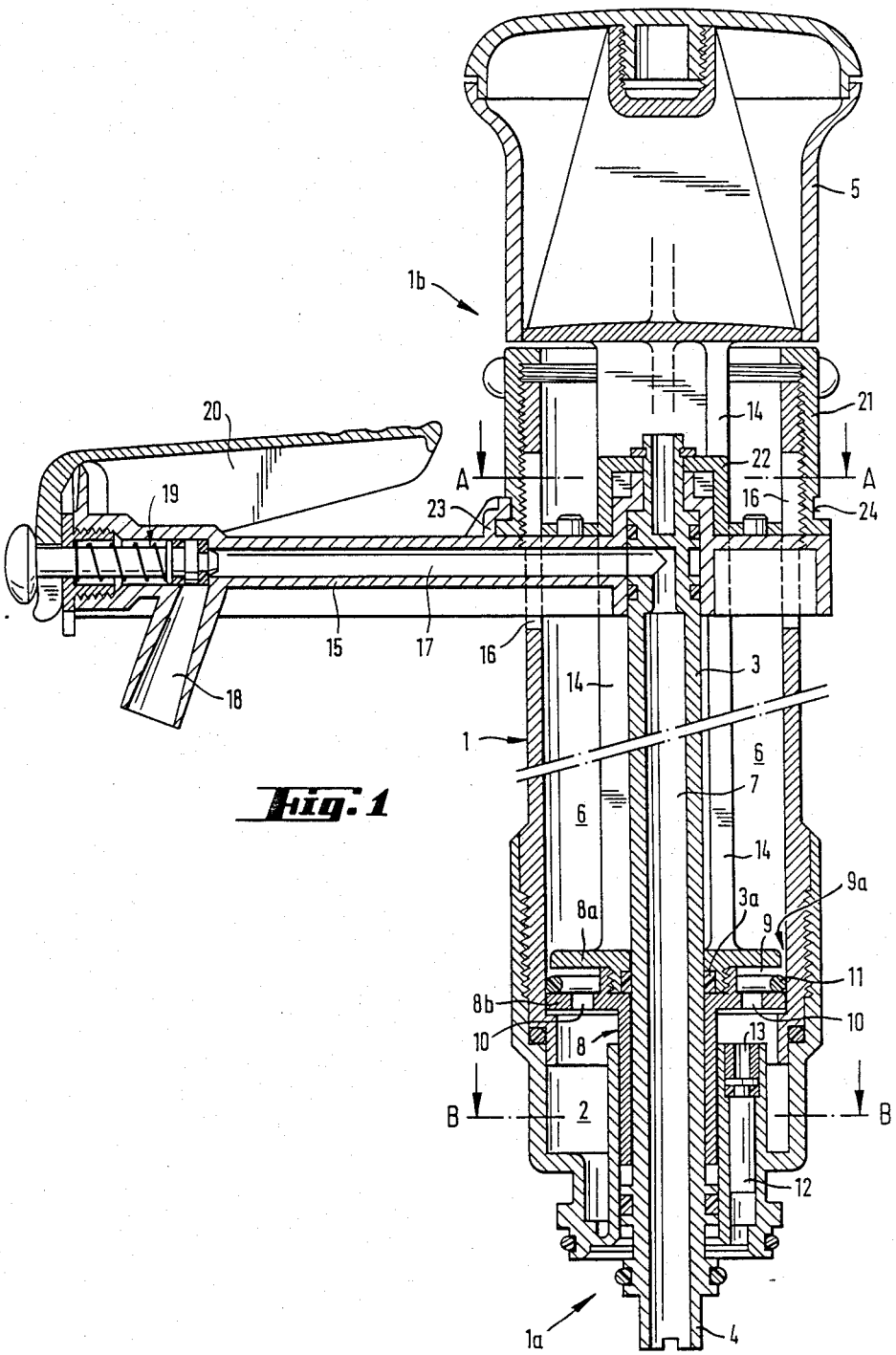
FIG. 1 shows a view in longitudinal section of a keg tap.

The keg tap comprises an essentially cylindrical housing 1, through which a valve-opening rod 3 is inserted and extends over the entire length of the housing interior. At the end 1*a* of the housing 1 which is to be connected to the keg seal in the vessel (not shown), the valve-opening rod 3 projects and here is designed as a valve-opening element 4. The opposite end of the valve-opening rod 3 interacts with an actuating part which is arranged at the top end 1*b* of the housing. In the exemplary embodiment illustrated, the actuating part comprises a threaded ring 21, as will be described in more detail.

A continuous axial bore leads through the valve-opening rod 3, is designed as a liquid passage 7 and makes the connection between a riser pipe in the vessel (not shown) containing the liquid and a liquid duct 17 which is arranged essentially at right angles to the liquid passage 7. This liquid duct 17 is cut out in a stirrup 15 which is inserted through a recess 16 in the wall of the housing 1 and which extends transversely through the housing space 6. The stirrup 15 is equipped with an outflow conduit 18 leading out of the liquid duct 17 and located directly behind a shut-off valve 19 actuated by means of a lever 20. Tapping is carried out here in a known way without any dripping.

As a result of this arrangement, a straight vertical liquid passage 7 leads through the valve-opening rod 3 which thus serves at the same time as a riser pipe and which is virtually the extension in a straight line of the riser pipe located inside the vessel. This liquid passage 7 merges into a likewise straight liquid duct 17, from which the beverage can be tapped by opening the shut-off valve 19.

The pressure space 2 is arranged in the lower region of the housing 1 and is limited by a piston 8, by means of which pressure medium, for example air, is introduced into the vessel. The valve-opening rod 3 is guided slidably through a central axial bore in this piston 8 and is sealed off by means of a gasket 3*a*, for example an O-ring. The piston 8 comprises two piston disks 8*a* and 8*b* which are arranged at a distance from one another and which limit an interspace 9, into which is inserted a sealing element 11 which allows or prevents the supply of pressure medium when the piston 8 is actuated. The piston disk 8*b* facing the pressure space 2 has at least one, but preferably two bores 10 which connect the interspace 9 between the piston disks 8*a* and 8*b* to the pressure space 2. The piston 8 is connected by means of piston rods 14 to a handle 5 which is arranged at the end 1*b* of the housing 1. As a result of the axial movement of this handle 5, the piston 8 is moved into the working and nonworking positions, with the effect that the sealing element 11 resting against the inner wall of the housing 1 closes or opens a gap 9*a* between the peripheral edge of the upper piston disk 8*a* and the inner wall of the housing 1. In the last-mentioned case, there is a connection between the housing space 6, the interspace 9 between the piston disks 8*a* and 8*b*, and the outlet 10 in the piston disk 8*b* to the pressure space 2 and from here to the outflow duct 13 leading to the vessel. The duct 13 has a non-return valve 12 which allows the pressure medium to flow into the vessel during the working stroke, but does not allow the pressure medium to flow back during the return stroke.

The actuating part for the valve-opening rod 3 is arranged between the underside of the handle 5 and the top side of the stirrup 15. Appropriately, this is a threaded ring 21 which is connected to the stirrup 15 and consequently to the valve-opening rod 3 in such a way that, when the threaded ring rotates, these two parts, namely the stirrup 15 and the valve-opening rod 3, are raised or lowered.

The stirrup 15 and the valve-opening rod 3 are connected firmly to one another and for stabilization are secured by a retention means 22 engaging over them. At least one connection piece 23, which is provided on the stirrup 15 and only part of which is shown in FIG. 1, engages into a peripheral groove 24 in the threaded ring 21 and slides in this groove when the threaded ring is rotated.

As a result of appropriate rotation of the threaded ring 21, the valve-opening rod 3 is moved against the valve in the keg seal (not shown) and opens this. The valve-opening rod 3 then become$ the riser pipe, the liquid passage 7 of which communicates with the riser pipe in the vessel. If required, that is to say if pressure is to be built up in the vessel, the handle 5 and consequently the piston 8 are actuated and feed pressure medium to the vessel interior.

In the keg tap according to the invention, the valve-opening rod 3 , because of the liquid passage 7 incorporated in it, is at the same time a broaching and opening element for the keg seal and a riser pipe for extracting the beverage from the vessel.

Air is preferably used as a pressure medium. With slight changes not essentially affecting the features of the construction, the keg tap can also be designed for use with carbon dioxide as the pressure medium. In this case, an appropriate valve takes the place of the piston construction.

I claim:

1. A key tap for dispensing a liquid from a vessel having a keg seal, comprising:

an essentially cylindrical housing;

an axially movable valve-opening rod located within the housing and extending along essentially the entire length of the housing, one end of said valve-opening rod projecting out of one end of said housing so as to define a valve-opening element which interacts with the keg seal, said valve-opening rod having a continuous liquid passage therein which is open at said one end of the valve-opening rod;

moving means for moving said valve-opening rod axially;

a stirrup extending through a recess in a side wall of the housing in a direction essentially perpendicular to said valve-opening rod, said stirrup having a liquid duct therein which is connected to the liquid passage in said valve-opening rod at a point adjacent an end of the valve-opening rod opposing said one end of the valve-opening rod;

an outflow conduit connected to said stirrup;

valve means for selectively connecting a passage in said outflow conduit to the liquid duct of said stirrup; a piston which is movable within said housing and which defines a pressure space adjacent said one end of the housing, said piston having a central axial bore through which said valve-opening rod is axially movable, said piston comprising a gasket which selectively seals an outlet from said pressure space;

a handle located at an end of said housing opposing said one end of the housing;

at least one piston rod connecting the piston to the handle; and an outflow duct connected to said pressure space, said outflows duct having a non-return valve which allows a pressure medium to flow out from said pressure space through said outflow duct but not into said pressure space through said outflow duct.

2. The keg tap as claimed in claim 1, wherein said piston comprises two piston disks spaced apart so as to define an interspace between the piston disks, one of said piston disks having at least one bore therethrough which connects said interspace with said pressure space, wherein said gasket is disposed in said interspace and presses against the inner wall of the housing, and wherein said outlet from the pressure space is an outlet gap located between the interspace and a housing space located outside said pressure space.

3. The keg tap as claimed in claim 1, wherein said stirrup is fixedly connected to the valve-opening rod and is movable with the valve-opening rod.

4. The keg tap as claimed in claim 3, wherein said moving means comprises a threaded ring rotatably mounted on the housing between the handle and the stirrup, said threaded ring being coupled to said stirrup such that when the threaded ring is rotated, the stirrup and the valve-opening rod move axially.

5. The keg tap as claimed in claim 4, wherein said threaded ring has a peripheral groove located therein, and said stirrup has a retention means which engages in said peripheral groove.

* * * * *